US005855228A

United States Patent [19]

Perach

[11] Patent Number: 5,855,228

[45] Date of Patent: Jan. 5, 1999

[54] CONTROL VALVE ASSEMBLY

[76] Inventor: Asi Perach, 29650 White Hall Dr., Farmington Hills, Mich. 48018

[21] Appl. No.: 524,136

[22] Filed: Sep. 5, 1995

[51] Int. Cl.[6] ..... F15B 13/044

[52] U.S. Cl. ..... 137/625.65; 137/269; 137/625.27; 251/129.16; 251/129.22

[58] Field of Search ..... 137/269, 625.27, 137/625.65; 251/129.16, 129.22

[56] References Cited

U.S. PATENT DOCUMENTS

| | | | |
|---|---|---|---|
| 2,934,090 | 4/1960 | Kenann et al. | 137/625.27 X |
| 3,498,330 | 3/1970 | Paige | 137/625.65 |
| 3,661,183 | 5/1972 | Komaroff . | |
| 3,732,893 | 5/1973 | Ziesche et al. | 137/625.65 |
| 4,005,733 | 2/1977 | Riddel | 137/625.65 |
| 4,719,943 | 1/1988 | Perach . | |

*Primary Examiner*—Gerald A. Michalsky
*Attorney, Agent, or Firm*—Arnold S. Weintraub

[57] ABSTRACT

The valve of the present invention includes a housing and a valve body. The valve body includes a key piece selected so that the valve may function as a normally-on valve or a normally-off valve depending upon the key piece selected. The valve of the present invention additionally includes a first ring and a second ring wherein each ring ensures proper supply of pressurized high flow rate media through the valve.

20 Claims, 5 Drawing Sheets

FIG 3
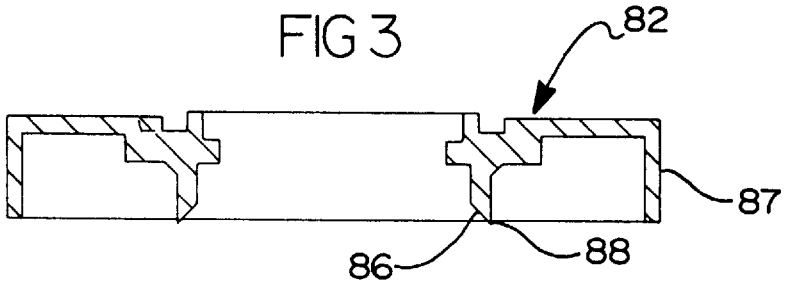
FIG 4
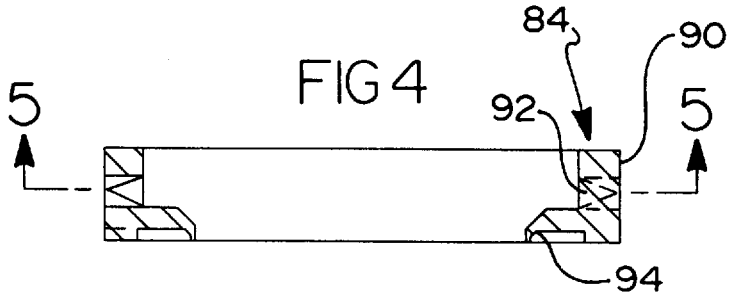
FIG 5
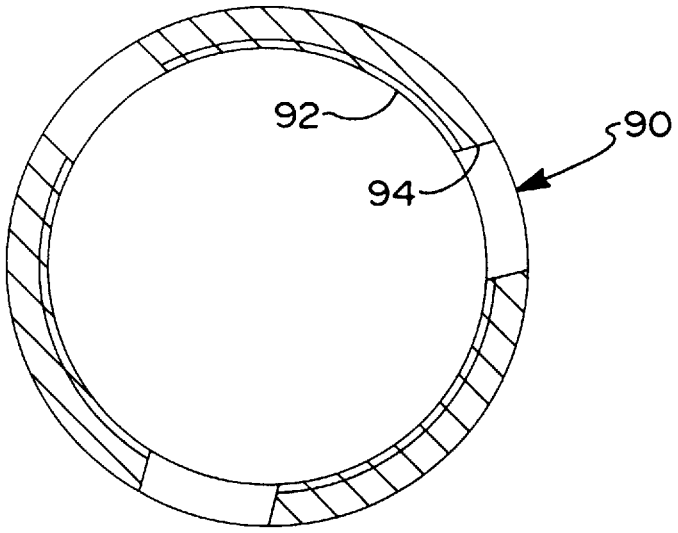
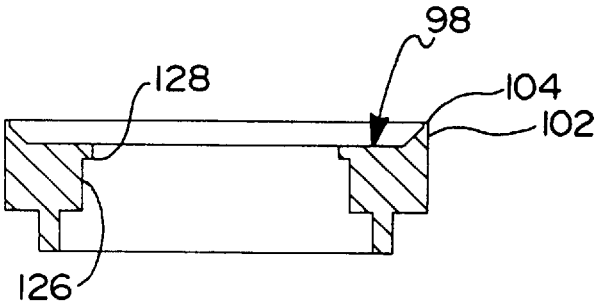
FIG 6

FIG 7
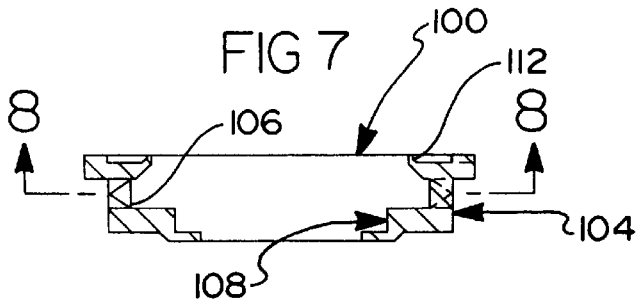
FIG 8
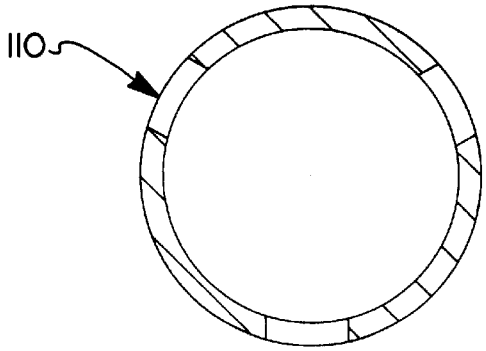
FIG 9
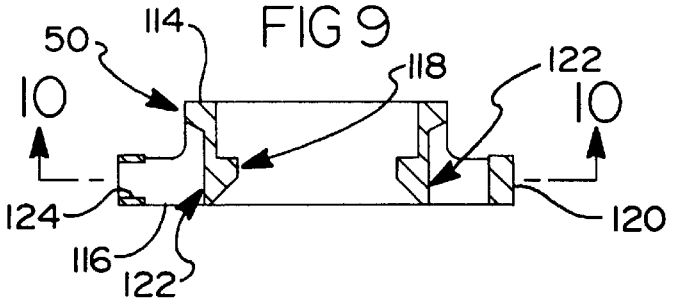
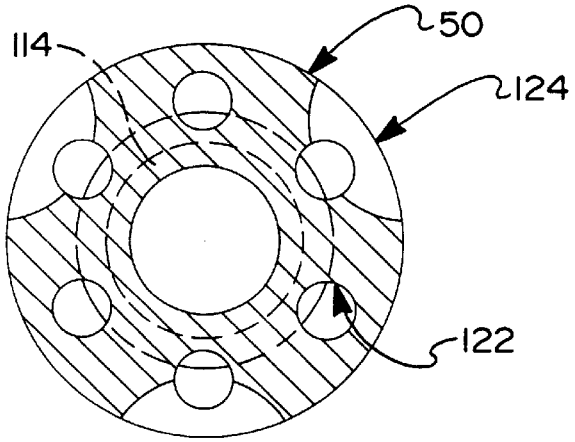
FIG 10

FIG 11
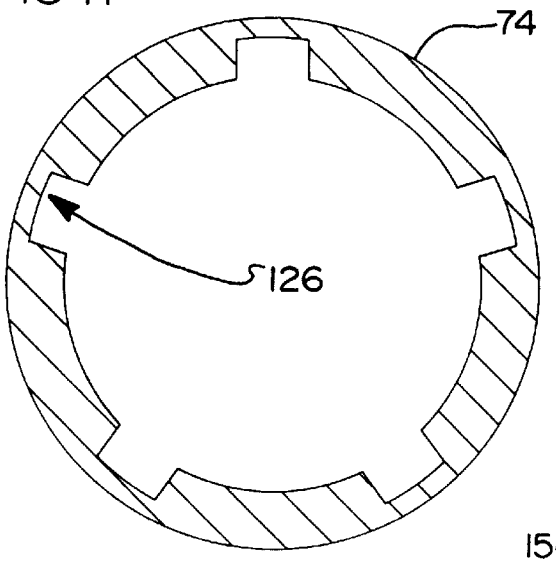
FIG 12
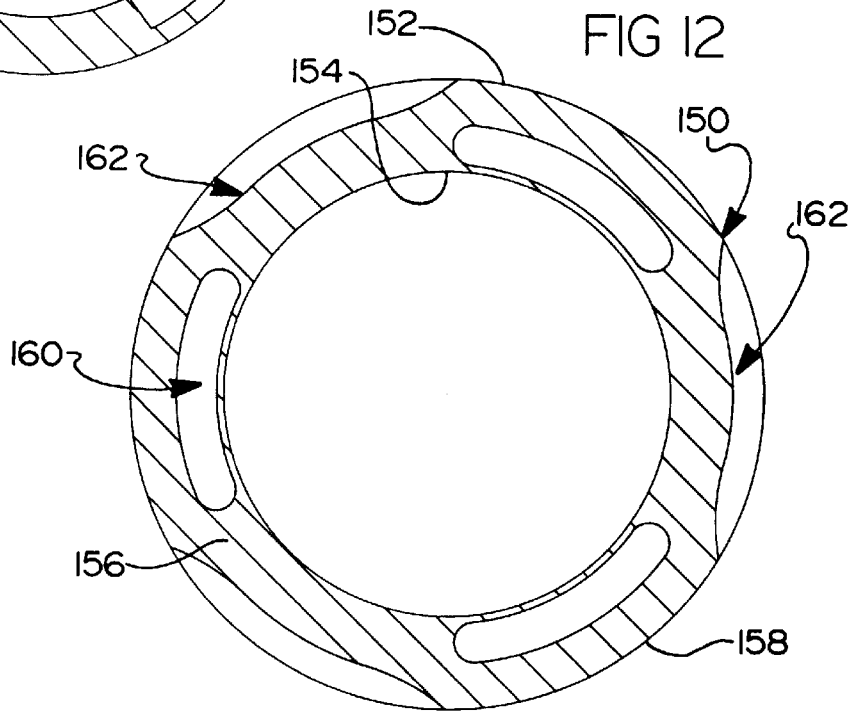
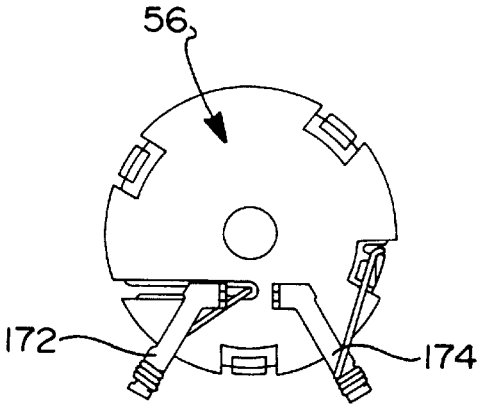
FIG13
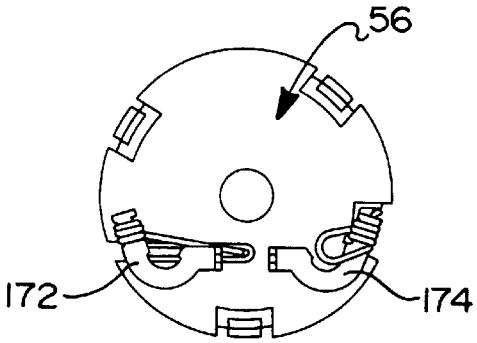
FIG14

CONTROL VALVE ASSEMBLY

BACKGROUND OF THE INVENTION

1. Field of the Invention

The present invention relates to valve assemblies and more particularly to a valve assembly for providing a controlled pressurized flow to a device. Even more particularly, the present invention provides a configurable valve assembly having both high speed response and flow rate.

2. Description of the Prior Art

Many valves for controlling differential fluid flows and pressures have been developed. U.S. Pat. No. 4,005,733 entitled PRESSURE CONTROL VALVE teaches a valve with a pair of axially spaced inlets in fluid communication with a chamber; the chamber is, in turn, in fluid communication with a consumer which receives the pressurized fluid flow.

Pressure in, and flow through the chamber is varied by an oscillating valve member. The valve member is movable to a first position which opens a first inlet and closes a second inlet. The valve member has a second position which closes the second inlet and opens the first inlet. The valve is solenoid operated and includes the valve member which acts as the solenoid armature.

An example of a high-frequency valve is shown in U.S. Pat. No. 3,661,183 entitled ELECTROMAGNETICALLY OPERATED VALVE WITH TWO SEATS which discloses a valve having a spherical valve member, a control chamber and two seats. In this valve, the spherical valve member is disposed in the control chamber between the two seats. Movement of the valve member results (in one direction) from a force exerted by an armature. The armature extends into the control chamber and is pressed against the valve member by a spring. Thus, the spring holds the valve member against one seat. The armature is retracted to a disengaged position from the valve member by a solenoid to allow fluid pressure to float the valve member to the other seat, as does the valve shown in U.S. Pat. No. 4,005,773. Operation of this valve depends on the pressure of the fluid at one port urging the valve member into engagement with the opposing valve seat.

In U.S. Pat. No. 4,719,943, a CONTROL VALVE ASSEMBLY is disclosed wherein a poppet connected to a control arm is positionable between a first and a second position through the use of a spring and a solenoid. The poppet provides fluid flow between one of a plurality of inlets and one of a plurality of outlets in response to electrical signals transmitted to the solenoid via wiring. Electrical pulses are dispatched to the solenoid moving the poppet between a first and a second position at a high frequency.

Several problems exist with each of the above mentioned valves. First, each of the above described valves fails to provide means for high flow rate of fluid therethrough at high fluid pressure because the cross-sectional areas of the pathways adjacent to the valve member are quite large. Therefore, if one were to attempt to apply a great deal of pressure with the great surface area afforded, the valves would fail to function properly. Essentially, leakage would occur around the edges of the valve member, or the great pressure may actually move the valve member from a first to a second position, essentially holding the valve in the open state, and damaging the devices to which it is connected.

Therefore, presently, one has available only valves that operate with either a high flow rate or high pressure, but not both. When using heavy equipment, use of a valve that can withstand high pressures is essential, as many operations such as lifting the equipment require a high pressure. In just such a case, a valve having a slow fluid flow rate must be used, making such operations tedious.

Additionally, each of the above referenced patents discloses a valve which is in the "normally-closed" state. The springs included in each of the above referenced valves biases the valve member in a closed configuration. By supplying electrical energy to a magnet therein, the valve member is "pulled" in the opposite direction to "open" the valve. Normally-closed valves are generally used to ensure that if the valve fails, the valve failure will not cause other equipment to fail or be damaged. However, there is sometimes a need for the valve to be in an open configuration if the equipment fails. As such, the prior art is deficient in supplying a valve that may be configured as either a normally open valve or a normally closed valve.

It is also to be appreciated that the above referenced valves were designed for use with a liquid and not a gas. If a gas were fed through previously produced valves such as those disclosed above, it would tend to seep out of the valve at several points. Essentially, the above referenced valves were not designed to be used with a gas.

What is needed is a valve that functions at a high flow rate and at a high fluid pressure. Additionally, a valve is needed that can be used with both liquids and gasses. It would also be preferable to have a valve that could be produced in either the normally-open or the normally-closed state depending upon the application in which the valve is to be employed. It is to the solution of the above mentioned problems to which the present invention pertains.

SUMMARY OF THE INVENTION

In accordance with the present invention there is provided a valve comprising:

- a housing having a top surface, a bottom surface and a longitudinal axis extending between the top surface and the bottom surface, the housing further defining:
  - (1) a delivery port;
  - (2) a supply port in fluid communication with a supply ring;
  - (3) a sink port in fluid communication with a sink ring;
- a valve body formed within the housing, the valve body comprising:
  - (1) a supply ring disposed coaxial with the longitudinal axis of the housing;
  - (2) a sink ring opposedly disposed the first ring and coaxial with the longitudinal axis of the housing;
  - (3) a valve disk disposed intermediate the supply ring and the sink ring, the valve disk movable between a position abutting the sink ring to thereby connect the supply port and the delivery port and a second position abutting the supply ring to thereby connect the delivery port and the sink port.

The valve of the present invention includes a housing which is preferably formed from some strong, corrosion resistant, durable material, such as steel, or some other hard metal or plastic. The housing may be cylindrical in shape, having a top portion, a bottom portion, and a side-wall extending therebetween. The housing has a longitudinal axis extending between the top portion and the bottom portion. Additionally, the housing may have several apertures formed in the side-wall, and at the bottom surface, each of which serve as various input and output ports for the valve.

The valve of the present invention additionally includes a valve body which is sealably housed within the housing and includes several components. The valve body includes a first, upper ring disposed coaxial with the longitudinal axis of the housing. The first ring may be formed from one or more individual components which cooperate to define an annular, or circular pathway through which media, or fluid flows.

The valve of the present invention additionally includes a second, lower ring opposedly disposed the first ring and coaxial with the longitudinal axis of the housing. The second ring may be additionally defined by one or more components which cooperate to define an annular, or circular pathway through which media flows.

Additionally, the valve of the present invention, is envisioned as including one of two interchangeable keys which configure the valve to be either normally-open or normally-closed. It is understood in the art, that a normally-open valve has a default configuration such that a supply port is in communication with a delivery port. A normally-closed valve has a default configuration such that a delivery port is in communication with a sink port.

If the valve includes the normally-open key, then, the first ring is in fluid communication with a supply port at the bottom of the valve, and the valve of the present invention defaults to a configuration such that the supply port is in communication with the delivery port. In this instance, the first, upper ring, serves as the supply ring.

If the valve includes the normally-closed key, then the first ring is in communication with a sink port which is, essentially, an aperture formed in the side-wall of the housing. In this case, the first, upper ring, serves as the sink ring and the valve has a default position wherein the delivery port is in communication with the sink port.

A valve disk is preferably disposed intermediate the first ring and the second ring. The valve disk may have a plurality of apertures formed therethrough, wherein the apertures are parallel with the longitudinal axis of the valve housing. The apertures are provided to ensure a constant pressure on both sides of the valve disk.

The valve disk may also include a plurality of channels formed normal to and in communication with a corresponding one of the plurality of apertures formed in the valve disk. Once again, the plurality of channels are provided to ensure a constant pressure around the valve disk.

The valve disk is preferably downwardly biased by a spring included in the valve body. In this way, the valve disk has the inclination to seat on the second ring. Therefore, if the normally-open key is included in the valve of the present invention, the valve disk defaults to a position abutting the second ring, which serves as the sink ring, to thereby connect the supply port with the delivery port. If the normally-closed key is included in the valve of the present invention, the valve disk again defaults to a position abutting the second ring; however, in this instance, the second ring serves as the supply ring. Therefore, in a default position, the delivery port of the valve is in communication with the sink port.

As mentioned herein above, the valve of the present invention includes a delivery port, which is preferably an aperture formed in the side-wall of the housing. The delivery port is in fluid communication with either the supply port, or the sink port, depending upon the position of the valve disk. If the valve disk is abutting the supply ring, then the delivery port is in fluid communication with the sink port, allowing pressurized media flow from a device connected to the delivery port to either another device connected to the sink port, or to the outside environment. If the valve disk is abutting the sink ring, then the supply port is in fluid communication with the delivery port, providing delivery of pressurized media from the supply port to a device connected to the delivery port.

Preferably, the valve of the present invention includes a coil of wire, which may be energized, i.e. have current flowing therethrough, or de-energized, i.e. have no current flowing therethrough. The position of the valve disk is controlled by the energization or de-energization of the coil. When the coil is energized, the valve disk seats against the first ring. When the coil is de-energized, the default position, the valve disk seats against the second ring.

It is to be additionally appreciated that the first ring serves as a supply ring, i.e. in communication with the supply port when the normally-open key is included in the valve body. Alternatively, the first ring serves as a sink ring, i.e. in communication with the sink port, when the normally-closed key is included in the valve body.

For a more complete understanding of the present invention reference is made to the following detailed description and accompanying drawings. In the drawings, like reference characters refer to like parts throughout the several views, in which:

DESCRIPTION OF THE DRAWINGS

FIG. 3 is a cross-sectional view of an inside component of the first ring in accordance with the valve of the present invention;

FIG. 4 is a lateral cross-sectional view of an outside component of the first ring in accordance with the valve of the present invention;

FIG. 5 is a top cross-sectional view of the outside component of the first ring taken along line 5—5 of FIG. 4;

FIG. 6 is a lateral cross-sectional view of an inside component of the second ring in accordance with the valve of the present invention;

FIG. 7 is a lateral cross-sectional view of an outside component of the second ring in accordance with the valve of the present invention;

FIG. 8 is a top cross-sectional view of the outside component of the second ring taken along line 8—8 of FIG. 7;

FIG. 9 is a lateral cross-sectional view of the valve disk in accordance with the valve of the present invention;

FIG. 10 is a top cross-sectional view of the valve disk taken along line 10—10 of FIG. 9;

FIG. 11 is a top plan view of a spacer in accordance with the present invention;

FIG. 12 is a top plan view of the normally-off key in accordance with the valve of the present invention;

FIG. 13 is a top plan view of a washer in an unbent position in accordance with the present invention; and FIG. 14 is a top plan view of a washer in a bent configuration in accordance with the present invention.

DETAILED DESCRIPTION OF THE PREFERRED EMBODIMENTS

Figure 1:
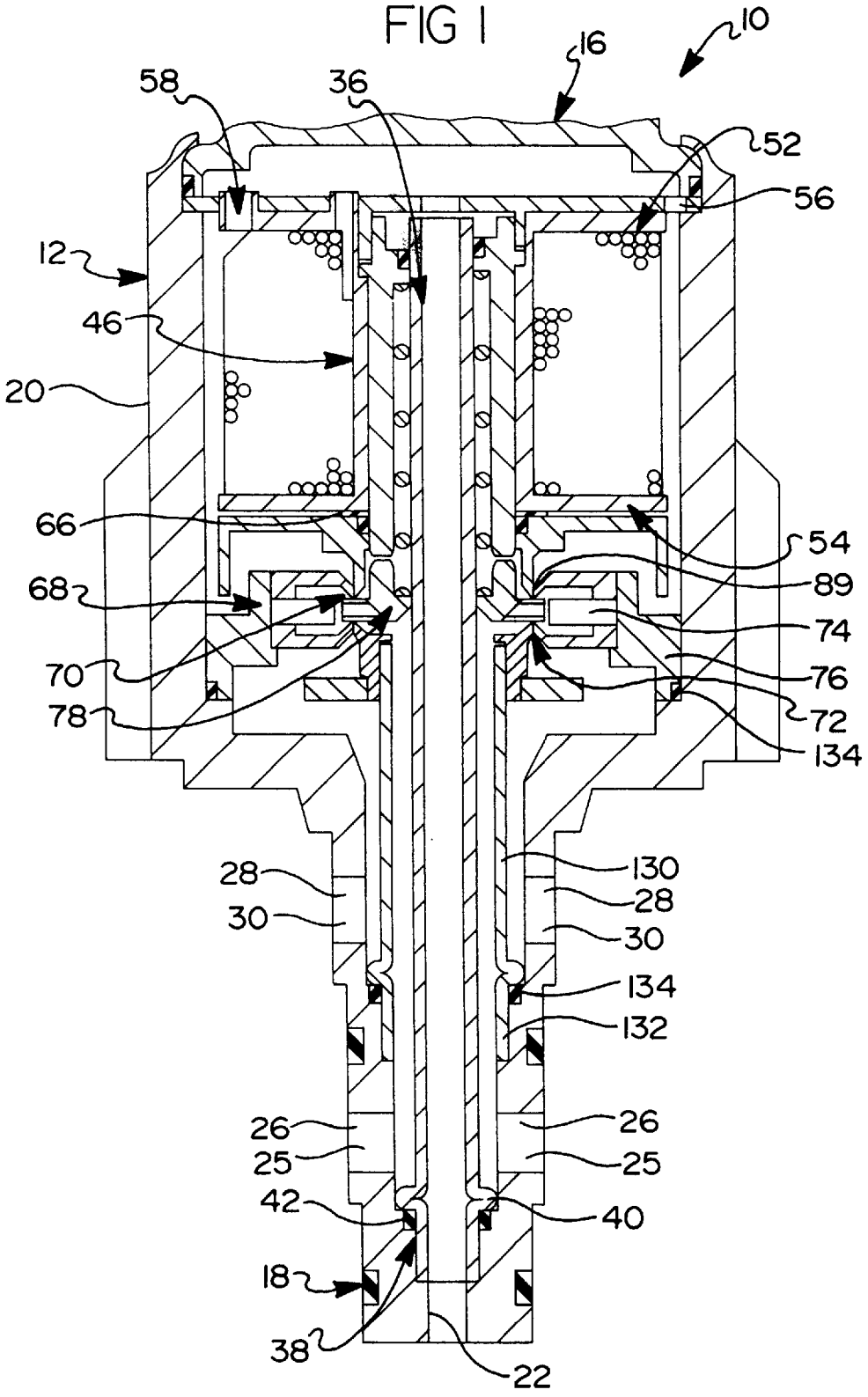
FIG. 1 is an axial sectional view of a valve according to the present invention wherein the valve includes the normally-on key.

FIGS. 1 depicts the preferred embodiment of the valve 10 in accordance with the present invention. The valve 10 generally includes a housing 12, and a valve body 14 housed within the housing 12. The housing 14 includes a top portion 16 having a first diameter, a bottom portion 18 having a diameter smaller than the top portion 16, and an annular side-wall 20 extending between the top portion 16 and the bottom portion 18.

A longitudinal axis Am extends from the top portion 16 to the bottom portion 18. The side wall 20 is coaxial with this longitudinal axis. The housing is preferably formed from a strong durable material that is capable of conducting magnetic flux, such as steel or some other material known to the skilled artisan. The housing 12 must conduct magnetic flux for the valve 10 to function properly. The reasons for which are set out herein below.

An aperture 22 is formed parallel to the longitudinal axis of the housing 12 at the bottom portion 18 thereof. This aperture 22 serves as the supply port 24 of the valve 10. Such an aperture 22 may be cast as a part of the housing 12, or it may be drilled out of the housing after the housing 12 has been cast.

The housing additionally includes a first plurality of apertures 25 formed in the side wall 20 proximate the bottom portion 18. These apertures 25 serve as a delivery port 26 for in the housing to serve as the delivery port 26. However, more, or fewer apertures may be used.

The housing also has a second plurality of apertures 28 formed above the first plurality 25 of apertures. The second plurality of apertures 28 serves as the sink port 30 of the valve 10. The second plurality of apertures 28 may be formed in the housing 12 when the housing is cast, or they may be drilled into the housing 12 afterward. Either method is appropriate in the instant invention. It is to be additionally appreciated that the sink port may alternatively be positioned below the delivery port.

It is to be appreciated that although the valve 10 of the present invention is pictured as including pluralities of apertures which serve as a delivery port 26 and a sink port 30, a single aperture may be used to serve as each. This is not preferred, though, as a plurality of apertures provides greater fluid flow into and out of the valve.

The valve body 14 inside the housing 12 includes a pole piece 32 which has a top portion 36 and a bottom portion 38. The pole piece 32 extends circumferentially about the axis Am. The pole piece 32 additionally interiorly extends between the top portion 16 of the housing 12 and the bottom portion 18 of the housing 12. The pole piece 32 has a passage 34 which extends axially in the pole piece. The passage 34 is in fluid communication with the supply port 24. In this way, fluid which enters the valve 10 at the supply port 24 can flow into the valve 10 via the passage 34 formed in the pole piece 32.

At its bottom portion 38, the pole piece 32 is crimped. Proximate the crimp 40 in the pole piece 32 an o-ring 42 is disposed between the pole piece 32 and the housing 12. The crimp 40 in the pole piece 32 and the o-ring 42 ensure that fluid flowing at the outside of the pole piece 32 does not seep between the exterior of the pole piece 32 and the housing 12. The flow of media, or fluid about the exterior of the pole piece 32 will be explained hereinbelow.

A spring 44 radially surrounds the pole piece 32 at its top portion 36. The spring may be formed from some strong durable material such as steel, hard plastic or the like. The spring 44 has a top end 47 and a bottom end 48. The bottom end 48 of the spring 44 abuts a valve disk 50 which will described in detail herein below.

A bobbin 46 having a top surface 52 and a bottom surface 54 radially surrounds the spring 44 and is coaxial with axis Am. An electromagnetic coil 58 having a first end 60 and a second end 62 is wound about the bobbin 46. Any well-known, small diameter electromagnetic coil, such as copper, may be utilized for such a purpose. A gap exists between the bobbin and the housing so that media, such as a fluid, may freely flow therebetween.

The bobbin 46 has a washer 56 attached thereto at its top surface 52. The washer 56, as depicted in FIGS. 1, 2 and 13 and 14, is preferably formed from a material which will conduct magnetic flux, such as steel or the like. The washer 56 includes a plurality of apertures 57 formed therein.

Both the first end 60 and the second end 62 of the electromagnetic coil 58 pass through one of the plurality of apertures 57 formed in the washer 56 and are attached to a set of terminals 64 which pass through the housing 12 at its top portion 16. The terminals are attached to a power supply (not shown) which will intermittently provide a current to the electromagnetic coil 58. The function of the coil 58 will explained in greater detail hereinbelow.

The valve body 14 additionally includes a cocoon 68. The cocoon 68 is a collection of components which direct the flow of media through the valve 10. Each of the individual components of the cocoon 68 will described hereinbelow in detail with reference to specific figures. The cocoon 68 generally seats in the top portion 16 of the housing 12 below the bobbin 46. A high durameter rubber disk 66 is disposed between the cocoon 68 and the bottom portion 54 of the bobbin 46. The rubber disk 66 is provided to ensure that a constant compressive force is applied to the cocoon 68 keeping the components of the cocoon 68 tightly compressed and aligned with each other and the other components of the valve 10. High durameter rubber disks are well-known in the art.

As depicted in FIG. 1, the cocoon 68 includes a first ring 70, a second ring 72, a stroke 74, a normally-on key 76 and a valve disk 78. Each of the components of the cocoon 68 is the same in FIG. 2 with the exception of the key, which is a normally-off key 80 therein.

The first ring 70 is coaxial with axis Am and is disposed above the valve disk 78 and below the bobbin 46. As depicted in FIGS. 3–5, the first ring 70 is formed from two pieces, an inside piece 82 and an outside piece 84.

The inside piece 82 is a substantially toroidal piece having a first downwardly extending shoulder 86 and a second downwardly extending shoulder 87. The first shoulder 86 terminates at a very thin rim 88.

The outside piece 84, is a substantially toroidal piece having an outer surface 90, an inner surface 92, and a downwardly extending shoulder 94. As depicted in FIG. 5, three channels 96 extend between the outer surface 90 and the inner surface 92 of the outside piece 84 of the first ring 70. The channels 96 allow media to flow therethough the purpose of which will be described hereinbelow.

The outside piece 84 is press fit to the inside piece 82 in between downwardly extending shoulder 86 and downwardly extending shoulder 87 such that a small gap 89 exists between downwardly extending shoulder 86 and downwardly extending shoulder 94. Media, which flows through the plurality of channels formed in the outside piece 84 may then flow between the two downwardly extending shoulders 86, 94.

Both downwardly extending shoulders 86 and 94 must terminate in the same plane. To accomplish this, inside piece 82 and outside piece 84 are lapped for a period of time to ensure that all three downwardly extending shoulders 86, 87, and 94 terminate as coplanar. Lapping pieces to accomplish this is well known in the art to which the present invention pertains.

The outside piece 84 and the inside piece 82 should be formed from some non-magnetic material such as stainless steel, or some type of ceramic. Essentially, both pieces 84 and 82 should be strong, durable, and non-magnetic. The reasons for the pieces being non-magnetic will be set out hereinbelow with regard to the functioning of the valve.

As depicted in FIGS. 1 and 6–8, the second ring 72 is coaxial with axis Am and is disposed below the valve disk 78 and above and abutting the key 76. The second ring 72 is formed from two pieces, an inside piece 98 and an outside piece 100.

The inside piece 98 is a substantially toroidal piece having a first upwardly extending shoulder 102. The first shoulder 102 terminates at a very thin rim 103, or nib.

The outside piece 100, is a substantially toroidal piece having an outer surface 104, an inner surface 106, an upwardly extending shoulder 112, and a radially inwardly extending shoulder 108. As depicted in FIG. 8, three channels 110 extend between the outer surface 104 and the inner surface 106 of the outside piece 100 of the second ring 72. The channels 110 allow media to flow therethough, the purpose of which will be described hereinbelow.

The outside piece 100 is press fit to the inside piece 98 at the radially inwardly extending shoulder 108. A small gap exists between upwardly extending shoulders 102 and 112. Media, which flows through the plurality of channels formed in the outside piece 100 may then flow between the two upwardly extending shoulders 102, 112, the purpose of which will be described hereinbelow.

Both upwardly extending shoulders 102, 112 must terminate in the same plane. To accomplish this, inside piece 98 and outside piece 100 are lapped for a period of time to ensure that both upwardly extending shoulders 102, 112 terminate as coplanar. Lapping pieces to ensure that they are coplanar is well known in the art to which the present invention pertains.

The outside piece 100 and the inside piece 98 should be formed from some non-magnetic material such as stainless steel, or some type of ceramic. Essentially, both pieces 100 and 98 should be strong, durable, and non-magnetic. The reasons for the pieces being non-magnetic will be set out hereinbelow with regard to the functioning of the valve.

As depicted in FIGS. 1, 2, 9 and 10, a valve disk 50 radially surrounds the pole piece 32. The valve disk 50 is generally toroidal and has an upper surface 114, a lower surface 116, an inner surface 118 and an outer surface 120. The valve disk 50 is disposed intermediate the first ring 70 and the second ring 72. The upper surface 114 of the valve disk 50 abuts the bottom end 48 of the spring 44. In this way, the spring 44 biases the valve disk 50 so that the lower surface 116 of the valve disk 50 seats against upwardly extending shoulders 102, 112 of the inside and the outside pieces that define the second ring 72. This essentially blocks the flow of any fluid from between the inside and outside pieces, which will be discussed hereinbelow.

The valve disk 50 includes a plurality of apertures 122 extending between the upper surface 114 and the lower surface 116 thereof. As it is intended that the valve disk 50 vibrate between a position abutting the first ring 70 and a position abutting the second ring 72, these apertures make movement of the disk easier if there is any fluid or other media surrounding the disk. As such, the valve disk 50 can slide up and down between the two rings 70 and 72. There is approximately 120 microns of space for the disk 50 to move in the vertical plane. To ensure that the valve disk moves easily, a small space, between 1 and 90 microns is provided between the inner surface 118 of the valve disk and the outside of the pole piece 32 which it annularly surrounds.

The valve disk 50 additionally includes three radially inwardly directed notches 124. These notches 124 serve to ensure that resistance to the movement of the valve disk 50 is at a minimum. Any media surrounding the valve disk 50 may flow through the apertures, or into a notch, which is in fluid communication with a corresponding one of the plurality of apertures 122. In order that the valve 10 of the present invention function properly, the valve disk 50 should be formed from a material that conducts magnetic flux. The reasons for this will become clear upon the explanation of the functioning of the valve.

A stroke or spacer 74 is disposed intermediate the first ring 70 and the second ring 72 , and radially surrounds the valve disk 50. The spacer 74 is depicted in FIG. 11. The spacer 74 is generally toroidal and a has a plurality of notches 126 formed therein. The notches 126 may be cut out of the spacer 74 after it has been formed, or the spacer may be cast as such. The spacer 74 ensures the proper distance between the first ring 70 and the second ring 72 and provides sufficient space for the valve disk 50 to slide up and down between the two. The plurality of notches 126 provided in the spacer 74 allow the passage of media, once again ensuring that the valve disk 50 can slide as easily as possible between the first ring 70 and the second ring 72. The spacer 74 should be formed out of a material that conducts magnetic flux, such as steel or the like, the purpose of which will become apparent upon an explanation of the functioning of the valve 10.

The inside piece 98 of the second ring additionally has an inner surface 126 and a radially inwardly extending shoulder 128. The shoulder 128 seats atop a control pole 130 which radially surrounds the pole piece 32 and extends downwardly from the point where it abuts the shoulder 128 of the inside piece of the second ring 72 to its bottom end 132 where it abuts a radially inwardly directed shoulder of the housing 12.

The control pole 130 is crimped just above its termination and an o-ring 134 is placed thereabout to ensure that any media or fluid will not leak into the area between the control pole 130 and the pole piece 32. These two cavities must be sealed from each other as the area between the control pole 130 and the pole piece 32 is in communication with the delivery port 26, while the area proximate the exterior of the control pole 130 is in fluid communication with the sink port 30.

As depicted in FIG. 1, the outside surface 90 of outside piece 84 of the first ring 70, as well as the outside surface of the spacer 74 and the outside surface 104 of the outside piece 100 of the second ring 72 all abut and seat against the normally-on key 76. The normally-on key 76 abuts against a radially inwardly directed shoulder 132 of the housing. An o-ring 134 is placed intermediate the normally-on key 76 and the housing 12 to ensure that there is no fluid flow therebetween.

The normally-on key 76 ensures that fluid which flows in at the supply port 22 will flow between the outside and inside pieces of the first ring 70. The normally-on key 76 additionally ensures that fluid which flows out the sink port 30 originated at the delivery port 26.

The valve 10 of the present invention, having the normally-on key 76 as depicted in FIG. 1 functions thusly. First, fluid flows into the supply port 22 from a source (not shown). The fluid flows up through the pole piece 32 and exits the pole piece 32 at the top portion 16 of the housing.

The fluid (or other media) then flows radially outwardly surrounding the electromagnetic coil and into the first ring 70. It is apparent that the normally-on key 76 precludes flow into the second ring 72.

If an electrical charge is never applied to the valve 10, then the pressurized fluid will continue to flow from the supply port 22 through the first ring 70, down the space between the pole piece 32 and the control pole 130 and exit at the delivery port 26.

It is intended that electrical pulses be applied to the electromagnetic coil, however. In that case, fluid will flow as described above for the periods of time that the electromagnetic coil is not charged. However, if an electrical charge is supplied to the electromagnetic coil via terminals 64, magnetic flux is generated which runs down the housing 12, radially inwardly through the spacer 74, up through the valve disk 50 and up through the bobbin 46 and then radially outwardly through the washer 56 attached to the top portion 52 of the bobbin 46. This magnetic flux draws the valve disk 50 upwardly towards the bottom portion 54 of the bobbin 46. As such, the valve disk moves to a second position abutting the first ring 70. In this configuration, the delivery port 26 is in fluid communication with the sink port 30. Pressurized fluid which has built up in a device connected to the delivery port 26 escapes via the sink port 30. It is essential that only those pieces mentioned above be made of material that can transmit magnetic flux, otherwise there may not be enough of an attractive force between the bobbin and the valve disk to move the disk to a position abutting the first ring 70.

Electrical charges can be applied at a rate of between 0 Hz and about 600 Hz. By varying the length of the pulses, flow of pressurized media to a device connected to the delivery port 26 can be regulated. If there is no electrical charge applied to the valve 10 then pressurized media will continuously be delivered to a device connected to the delivery port 26.

Figure 2:
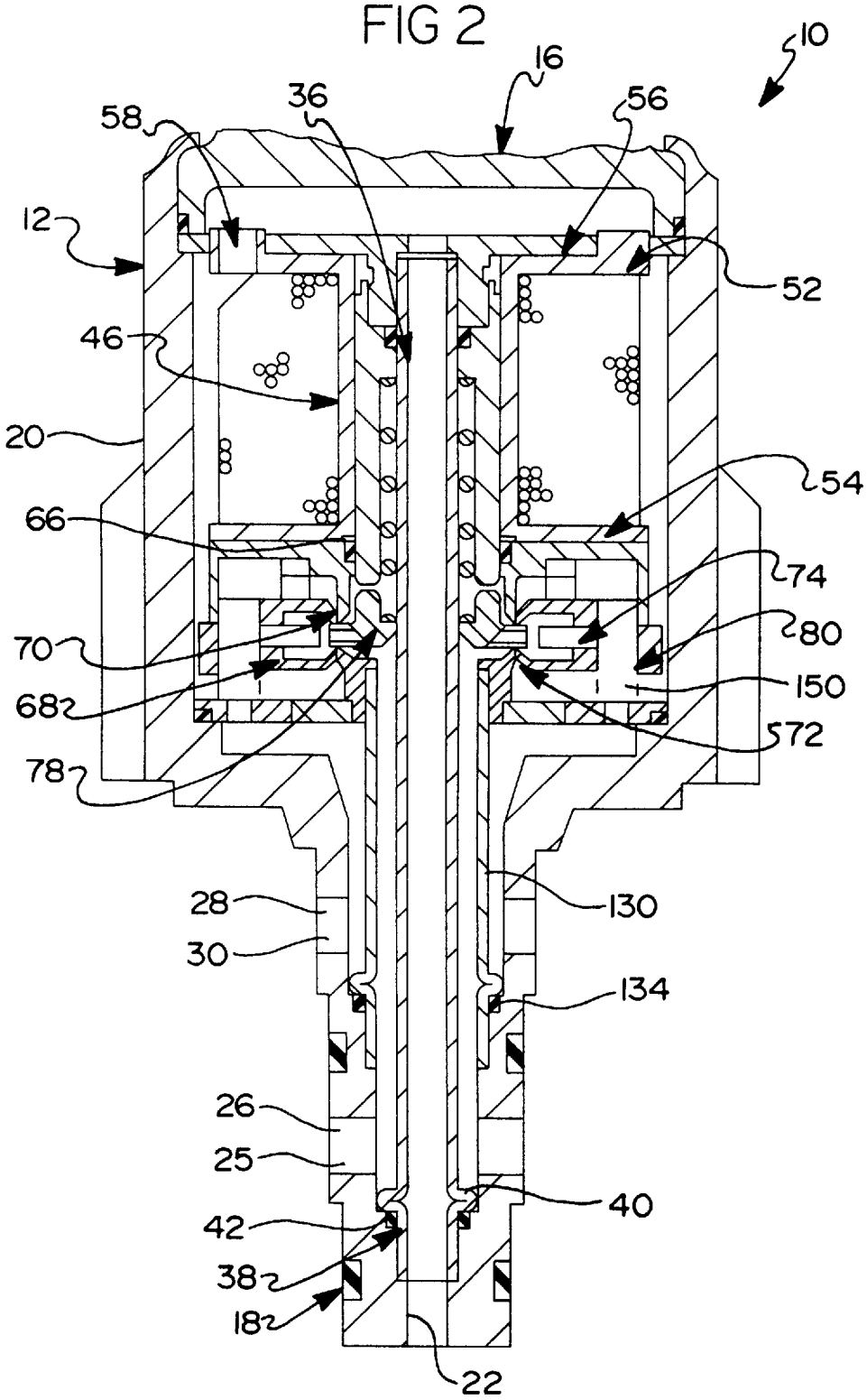
FIG. 2 is an axial sectional view of a valve according to the p resent invention wherein the valve includes the normally-off key.

There are instances where it is not advisable to have a continuous flow of pressurized media to a device if the valve 10 of the present invention should fail. In these cases, the valve 10 of the present invention would be produced with the normally-off key 150, as depicted in FIGS. 2 and 12. The normally-off key 150 seats in the same position as the normally-on key 76; however, the flow of media through this key 150 sends media from the supply port 22 to the second ring 72 as opposed to the first ring 70. In this way, if no electrical charge is applied to the valve, then the delivery port 26 is in fluid communication with the sink port 30 ensuring that a device attached to the delivery port 26 will not have a continuous stream of pressurized fluid flowing thereinto.

The normally-off key 150 is generally toroidal and has an outer surface 152, an inner surface 154, a top surface 156 and a bottom surface 158. A plurality of equally spaced apart apertures 160 extend from the top surface 156 to the bottom surface 158. Additionally a plurality of radially inwardly directed notches 162 are formed intermediate the top surface 156 and the bottom surface 158 and extend from the outer surface 152 to the inner surface 154 of the key 150. Also, three radially inwardly directed indents 162 are formed in the key 150 and extend from the top surface 156 to the point that the inwardly directed notches 162 are formed. There is a one to one correspondence between the indents and the notches. This is not required for the valve to function properly, but it is preferred to ensure maximum efficiency of the valve.

Depicted in FIG. 2, when the normally-off key 150 is in place, and a charge is applied to the valve 10 via the terminals 64, fluid flows into the valve 10 at the supply port 22. The fluid then travels downwardly in the space between the indents 162 in the key and the housing. The fluid then flows in through the inwardly directed notches 162 and into the second ring 72. The fluid then flows out of the second ring 72 and to the delivery port 26. It is to be appreciated that this occurs when a charge is applied to the valve.

If no charge is applied to the valve 10 depicted in FIG. 2, then the valve disk 50 seats on the second ring 72 and no fluid can flow therethrough. As such, the first ring 70 is not obstructed and fluid flows from the delivery port 26 up through the first ring 70, which is unobstructed because the valve disk 50 is seated against the second ring 72. The fluid then flows down through the apertures 160 in the normally-off key and into the sink port 30. Fluid cannot escape to the outside of the normally-off key, which ensures the proper functioning of the valve 10.

As depicted in FIGS. 13 and 14, the valve 10 of the present invention includes the washer 56 which was discussed herein above. Snap locks 170 attached to the bobbin 56 lock the washer in place. The washer 56 includes two terminals 172 and 174. A first end of the electromagnetic coil which is to be wound around the bobbin 46 is first attached to terminal 172 while it is in an extended position. After the electromagnetic coil is wound around the bobbin 46 then the second end thereof is attached to the second terminal 174. After this, both terminals are bent inwardly so that they do not extend beyond the periphery of the valve 10. In this fashion, the valve 10 may have a cap placed thereupon and then be installed into a piece of machinery or a vehicle.

The present invention provides a valve 10 that can function either as a normally-on valve or as a normally-off valve depending upon the key which is utilized therein. Additionally, the valve of the present invention provides high fluid flow rate at high pressure. Because the first and second rings provide an extremely small clearance through which fluid can flow, on the order of several microns, the valve disk can easily stop the flow of fluid therethrough when it abuts one of the rings. This ensures that the valve will function properly for a substantial amount of time even if the valve disk is moving back and forth between the two rings at a great rate of speed.

While the invention has been illustrated and described in detail in the drawings and the foregoing description, the same to be considered as illustrative and not restrictive in character, it being understood that only the preferred embodiment has been shown and described and that all changes and modifications that come within the spirit of the invention are desired to be protected.

Having thus described the present invention, what is claimed is:

1. A normally-on control valve comprising:

a housing having a top surface, a bottom surfaces and a longitudinal axis extending between the top surface and the bottom surface, the housing further including:

(1) a delivery port;

(2) a supply port;

(3) a sink port;

a valve body formed within the housing, the valve body comprising:

(1) a first ring defining a first annular fluid flow path disposed within and coaxial with the longitudinal axis of the housing, the ring having an entry;

(2) a second ring defining a second annular fluid flow path opposedly disposed the first ring and coaxial with the longitudinal axis of the housing, the second ring having an entry;

(3) a valve disk disposed intermediate the first ring and the second ring, the valve disk movable between a position abutting the first and the second rings, and wherein when the disk abuts the second ring it thereby connects the supply port with the delivery port and blocks the sink port, and when the disk abuts the first ring it thereby connects the delivery port with the sink port and blocks the supply port.

2. The control valve of claim 1 wherein the first ring comprises an inner rim and an outer rim.

3. The control valve of claim 1 wherein the second ring comprises an inner rim and an outer rim.

4. The control valve of claim 1 further comprising a bobbin, the bobbin providing electromagnetic forces to urge the valve disk to abut the first annular path radially surrounding the longitudinal axis of the housing.

5. The control valve of claim 4 further comprising a spring, the spring disposed between the bobbin and the longitudinal axis of the housing and radially surrounding the longitudinal axis of the housing, wherein the spring provides mechanical forces to urge the valve disk to abut the second annular path.

6. The control valve of claim 1 further comprising a spacer, the spacer comprising a opposed plurality of parallel surfaces, the spacer disposed intermediate the first ring and the second ring, the spacer controlling a stroke distance of the valve disk, and wherein each opposed parallel surface lies in the plane of an associated entry of the first and the second rings.

7. The control valve of claim 1 further comprising means for keeping the disk concentric to the axis of the housing.

8. The control valve of claim 7 wherein the means for keeping the disk concentric to the axis of the housing valve body comprises a tube extending between and connecting the supply port to the top surface of the housing.

9. The control valve of claim 7 further comprising a first and a second tube, wherein:

(1) the first tube extending between and connecting the supply port to the top surface of the housing, and (2) the second tube extending between and connecting the delivery port to the disk volume space.

10. The control valve of claim 1 wherein the valve body additionally comprises a normally-on key.

11. A normally-off control valve comprising:

a housing having a top surface, a bottom surface, and a longitudinal axis extending between the top surface and the bottom surface, the housing further defining:

(1) a delivery port;

(2) a supply port, (3) a sink port;

(4) a valve body formed within the housing, the valve body comprising:

(1) a first ring defining a first annular fluid flow path disposed within and coaxial with the longitudinal axis of the housing the ring having an entry;

(2) a second ring defining a second annular fluid flow path opposedly disposed the first ring and coaxial with the longitudinal axis of the housing the second ring having an entry;

(3) a valve disk disposed intermediate the first ring and the second ring, the valve disk movable between a position abutting the first and the second rings, and wherein when the disk abuts the first ring it thereby connects the supply port with the delivery port and blocks the sink port, and when the disk abuts the second ring it thereby connects the delivery port with the sink port and blocks the supply port.

12. The control valve of claim 11 further comprising a spacer comprising a plurality of opposed parallel surfaces, the spacer disposed intermediate the first ring and the second ring, the spacer controlling a stroke distance of the valve disk, and wherein each opposed parallel surface lies in the plane of an associated entry of the first and the second rings.

13. The control valve of claim 11 wherein the first ring comprises an inner rim and an outer rim.

14. The control valve of claim 11 wherein the second ring comprises an inner rim and an outer rim.

15. The control valve of claim 11 wherein the valve body additionally comprises a normally-off key disposed within and coaxial with the longitudinal axis of the housing, the normally-on key being cylindrical in shape and comprising:

(1) a top surface having:

(a) a plurality of apertures formed therein, and (b) a plurality of grooves formed in the surface and in communication with the plurality of apertures (2) a bottom surface opposite the top surface, the bottom surface defining the sink port;

(3) an inside surface;

(4) an outside surface;

(5) an inner cavity, defining a disk volume space, the disk volume space comprising a plurality of tunnels, and wherein the plurality of tunnels in the disk volume space connect the plurality of apertures in the top surface with the sink port in the bottom surface, and further wherein a fluid can flow through the plurality of holes in the top surface, through the tunnels in the disk volume space, and into the sink port.

16. The control valve of claim 11 further comprising means for keeping the disk concentric to the axis of the housing.

17. The control valve of claim 16 wherein the means for keeping the disk concentric to the axis of the housing valve body comprises a tube extending between and connecting the supply port to the top surface of the housing.

18. The control valve of claim 16 further comprising a first and a second tube, wherein:

(1) the first tube extending between and connecting the supply port to the top surface of the housing, and (2) the second tube extending between and connecting the delivery port to the disk volume space.

19. The control valve of claim 7 further comprising a bobbin, the bobbin providing electromagnetic forces to urge the valve disk to abut the first annular path radially surrounding the longitudinal axis of the housing.

20. The control valve of claim 19 further comprising a spring, the spring disposed between the bobbin and the longitudinal axis of the housing and radially surrounding the longitudinal axis of the housing, wherein the spring provides mechanical forces to urge the valve disk to abut the second annular path.

* * * * *